US010894626B2

(12) United States Patent
Chivrac et al.

(10) Patent No.: US 10,894,626 B2
(45) Date of Patent: Jan. 19, 2021

(54) PLASTIC BOTTLE WITH AN ANNULAR GRIPPING PORTION

(71) Applicants: COMPAGNIE GERVAIS DANONE, Paris (FR); SOCIETE ANONYME DES EAUX MINERALES D'EVIAN ET EN ABRÉGÉ "S.A.E.M.E", Evian-les-Bains (FR)

(72) Inventors: Frédéric Chivrac, Paris (FR); Alex James Orchard, Brussels (BE); Jean-Paul Besson, Abondance (FR)

(73) Assignees: COMPAGNIE GERVAIS DANONE, Paris (FR); SOCIETE ANONYME DES EAUX MINERALES D'EVIAN ET EN ABRÉGÉ "S.A.E.M.E", Evian-les-Bains (FR)

( * ) Notice: Subject to any disclaimer, the term of this patent is extended or adjusted under 35 U.S.C. 154(b) by 285 days.

(21) Appl. No.: 16/063,480

(22) PCT Filed: Aug. 26, 2016

(86) PCT No.: PCT/EP2016/070258
§ 371 (c)(1),
(2) Date: Jun. 18, 2018

(87) PCT Pub. No.: WO2017/102111
PCT Pub. Date: Jun. 22, 2017

(65) Prior Publication Data

US 2019/0002152 A1 Jan. 3, 2019

(30) Foreign Application Priority Data

Dec. 18, 2015 (WO) ..... PCT/IB2015/002573

(51) Int. Cl.
*B65D 1/02* (2006.01)
*B65D 23/10* (2006.01)

(52) U.S. Cl.
CPC ..... *B65D 1/0223* (2013.01); *B65D 23/102* (2013.01)

(58) Field of Classification Search
CPC ..... B65D 1/0223; B65D 1/0284; B65D 1/44; B65D 1/0238; B65D 1/0253;
(Continued)

(56) References Cited

U.S. PATENT DOCUMENTS 3,152,710 A 10/1964 Platte
8,870,017 B2 10/2014 Reeber et al.
(Continued)

FOREIGN PATENT DOCUMENTS

DE 8806145 U1 7/1988

OTHER PUBLICATIONS

International Search Report, dated Oct. 19, 2016, from corresponding PCT application No. PCT/EP2016/070258.

*Primary Examiner* — Anthony D Stashick
*Assistant Examiner* — L Kmet
(74) *Attorney, Agent, or Firm* — Nixon & Vanderhye

(57) ABSTRACT

The side wall, extending below a shoulder of the thermoplastic bottle, has a gripping portion formed substantially in the middle of the bottle body and includes a first line and a second line each defined in a vertical symmetry plane. The second line has a second point at minimal distance ds2 between the side wall and the central axis, while the first line has a first point at minimal distance dsl between the first line and the central axis. For these particular points in the gripping portion: ·ds2<ds1·hs1<hs2 A thick portion is provided at and above the second point.

16 Claims, 7 Drawing Sheets

(58) Field of Classification Search
CPC .. B65D 1/0276; B65D 23/102; B65D 79/005; B65D 2501/0018
USPC ..... 215/382, 383, 384
See application file for complete search history.

(56) References Cited

U.S. PATENT DOCUMENTS

| | | | | |
|---|---|---|---|---|
| D813,046 | S * | 3/2018 | Llewellyn | D9/552 |
| 2006/0213858 | A1 | 9/2006 | Kraus et al. | |
| 2007/0257003 | A1 | 11/2007 | Colloud | |
| 2014/0042119 | A1 | 2/2014 | Floyd et al. | |

* cited by examiner

PLASTIC BOTTLE WITH AN ANNULAR GRIPPING PORTION

FIELD OF THE INVENTION

The present invention generally relates to containers such as bottles used in food and drink packaging industry, particularly to thermoplastic bottles having an annular gripping portion and provided with improved resistance to vertical pressure, for example top loading stacking resistance. The invention also concerns a pack comprising such bottles.

BACKGROUND OF THE INVENTION

Liquid, flowable consumer products have been marketed in plastic bottles, such as those made of polyolefin or polyester. Exemplary bottle materials include polypropylene (PP) and polyethylene terephthalate (PET), polyethylene (PE) such as High Density Polyethylene (HDPE), Polylactic Acid (PLA). While water is conventionally packaged in transparent containers with relatively thin sidewalls, liquid yogurt may be packaged in non-transparent relatively thick sidewalls. Any quantities of food composition (e.g. 150-2000 mL) are capable of being packaged in durable and recyclable thermoplastic bottles with transparent or translucent and relatively thin sidewalls.

Those bottles filled with liquid products often need to be vertically stacked on top of one another, such as during transportation, warehouse storage and/or at point-of-purchase display. Other vertical pressure includes pressure applied upon capping. In order to increase resistance to vertical compression, for example top loading stacking resistance of plastic bottles, bottles with a smoothly curved continuous body wall have been found to have good top loading strength. When the body of the bottle includes interconnected walls, it is generally considered desirable to make the transition edge between the walls gradual or "rounded" in order to improve the top load strength of the bottle. Thus, bottles with curved and rounded body profiles are generally considered as having better resistance to vertical pressure, such as top loading strength, than bottles having more abrupt transitions.

However, continuously curved bodies are considered as providing to consumers a quite common visual impression (this is the case for the bodies of cylindrical shape for example). Additionally, compactness in a pack may be altered when having a middle part of the bottle that is too wide (this is the case for the spherical bodies for example). There is a need to providing bottles that can provide a different visual impression that can find some relevance for one product and/or brand or another.

Bottles provided with a gripping portion may be seen as compliant with the bulk constraints but are not well adapted for stacking when provided with significant recesses in an annular gripping portion. Besides, use of panels to obtain the gripping portion often requires high amount of plastic material. This is especially the case for hot-fill containers, with a maximum thickness generally of at least 900 or 1000 μm in the side wall and/or use of significant angles and projections at the surface. Document U.S. Pat. No. 8,870,017 shows such kind of bottle with panel segments defining the gripping portion.

When the thickness is reduced as compared to the hot-fill containers, gripping portions may also cause problems when pouring content of a bottle for some users, especially when the capacity reaches 1 L or more.

The bottle such as shown in document US 2007257003 reaches a compromise between the facility of use and the resistance to the vertical load. But the general shape of an individual bottle having such kind of gripping portion is quite standard. Other shapes that provide attractiveness are needed.

A circular design for the gripping zone has been also provided in some bottles of circular cross-section. But such design is considered not adapted for stacking constraints. When located at the bottom of a stack, such bottles may be subjected to substantial top loading forces and may buckle or even collapse, causing economic loss in terms of inventory replacement and the labor needed for clean-up, or damage to the facility or vehicle in which the collapse occurs.

Accordingly, there is a need to provide plastic bottles of improved design and easy to grasp, typically without planar panels, that minimize the amount of plastic to make the side wall, while having greater top loading resistance than bottles having a conventional annular gripping portion.

SUMMARY OF THE INVENTION

The purpose of the present invention is to provide bottles of optimized weight that have sufficient top loading resistance, while being perceived as attractive because of the ease of grasp and/or the general shape.

To this end, embodiments of the present invention provide a thermoplastic bottle comprising a bottom wall (adapted to define a support plane of the bottle), a neck provided with an opening of the bottle, a shoulder connected to the neck, and a side wall (less rigid than the neck) extending longitudinally around a first axis or central axis (which is a central axis of the bottle, preferably intersecting the opening), typically from an upper end adjacent to the shoulder to a lower end. In such bottle, the side wall has a symmetry plane including the central axis and comprises:

- optionally, a lower portion adjacent to the bottom wall and extending symmetrically around the central axis;
- a second line of the side wall and a first line of the side wall that are defined in the symmetry plane, entirely below the shoulder;
- at the second line, at least one thick portion;

wherein the second line is provided with a second point located at a radial distance ds2 from the central axis, which is the minimal distance between the side wall and the central axis, while the first line is provided with a first point at a radial distance ds1 from the central axis which is the minimal distance between the first line and the central axis;

wherein the following relations are satisfied:

$$ds2<ds1$$

$$hs1<hs2$$

where hs1 is height of the first point and hs2 is height of the second point, each measured parallel to the central axis from the support plane;

and where the radial distances ds1 and ds2 are each measured in the symmetry plane;

and wherein the thick portion extends at and above the second point defined in the second line, such thick portion having a thickness that is greater than the opposite thickness provided in the first line at same height as the height hs2 of the second point.

The first and second points are defined in opposite concave portions of the longitudinal profile of the side wall, so as to respectively define the point proximal with respect to the central axis for each of these concave portions in the longitudinal profiles. The difference in height level between the first point and the second point is of interest to increase gripping options for a user, as well as a visual impression linked to modernity, movement, action, fitness and/or femininity.

Of course, it is understood that the term "symmetry" is not to be interpreted in a strict manner as some changes for the thickness, label, marks or other minor differences may locally occur. It is sufficient that the halves of the side wall (as obtained on each side of the symmetry plane) are generally perceived as identical. The symmetry plane may divide the interior volume of the bottle into two substantially identical fractions of volume.

Preferably, the first point and the second point are defined in a same annular gripping recess that is tilted with respect to the support plane. The first point and second point may be included in a determined annular line (tilted with respect to the support plane) that defines a peripheral intersection between a first annular part and a second annular part, the first annular part and the second annular part longitudinally tapering in opposite directions and defining a gripping portion of the bottle.

The determined annular line extends preferably at a distance from an upper annular end of the second annular part, such upper annular end being directly connected to the shoulder.

In the annular gripping recess, the first point may be provided in a lowermost segment of the determined annular line and the second point may be provided in an uppermost segment of the determined annular line.

The two respective tapering portions provide and interesting visual impression linked to modernity, movement, action, fitness and/or femininity. It's been found that they have an additional guiding effect for the hand, which can be easily positioned along or close to the tilted annular line. The thumb naturally extends in a direction different from the other fingers in a hand ready to grasp a bottle; accordingly, the difference in level between the first point and the second points, and/or between the uppermost segment and the lowermost segment is considered advantageous to maintain such natural position for the thumb. Also, the user has more choice for positioning a hand at different area of the gripping portion (here the single gripping portion in the side wall), as compared to the bottles having two or more opposite gripping panels. Due to the simple annular shape, there is no column-like portion or intermediary panels or segments that limit positions for grasping by the user.

The gripping portion can be integrated advantageously in a more dynamic design of the bottle, which can contribute to communicate an identity of a product and/or of a brand. The tilted annular line and the two parts tapering toward this annular line may be perceived as a hip during a movement.

Besides, risk of deformation or collapse upon stacking is prevented in optimal manner by the presence of the thick portion, typically by increasing the thickness at least in a maximally recessed area of the gripping portion, especially in the adjacent area above the tilted annular line. Such area may be seen as similar as a spine, allowing limiting risk of torsion when the bottle is located at bottom of a stack. The thick portion with increase of thickness may have a longitudinal extension that is similar or at least equal to the difference of heights ("hs2−hs1") between the second point and the first point, and preferably superior or equal to 15 mm.

In a particular embodiment (hs2−hs1)/H>0.10, preferably (hs2−hs1)/H>0.12. In a particular embodiment (hs2−hs1)/H<0.30, preferably (hs2−hs1)/H<0.20.

According to a particular feature, the gripping portion (of tubular shape) defined in the side wall consists in the first annular part tapering toward the upper end of the side wall and the second annular part tapering toward the lower end of the side wall.

According to a particular feature, the thick portion has a minimum thickness at least 10 μm, preferably at least 20 μm, greater than the opposite thickness provided in the first line at same height as the second point. The thick portion can be the second point. Thus it can be sufficient that the thickness at the second point be greater than the thickness at the first point, preferably at least 10 μm greater, preferably at least 20 μm greater.

According to a feature, the second point and the first point are parts of a gripping portion having an annular recess maximally recessed at the second point, the gripping portion comprising:

the thick portion; and a central region defined between an annular lower limit extending at a constant height identical to the height of the first point and an annular upper limit extending at constant height identical to the height of the second point.

According to a feature, thickness of some, preferably all, points of the central region included in the symmetry plane is superior or equal to 220 μm, preferably 250 μm. Optionally, any thickness of the central region is superior or equal to 220 μm, preferably 250 μm.

According to a particular feature, the first annular part, which is tapering toward the upper end, is connected to the lower portion, the first annular part and the lower portion intersecting and interconnecting at a substantially circular peripheral intersection line that is perpendicular to the central axis.

According to a feature, the determined annular line has a single uppermost segment and a single lowermost segment, the uppermost segment being defined in a maximally recessed area of the gripping portion (at a distance from an upper annular end of the second annular part), so that the uppermost segment is closer radially to the central axis (first axis) than the lowermost segment of the determined annular line. Typically the uppermost segment comprises the second point. Typically the lowermost segment comprises the first point.

The symmetry plane of the side wall includes the first (central) axis and is intersecting the determined annular line at the second point that belongs to the uppermost segment and at the first point (opposite to the second point in the determined annular line) that belongs to the lowermost segment.

Optionally, the thick portion is part of the second annular part and extends between the upper annular end of the second annular part and the second point. In an embodiment the thick portion is the second point. Such thick portion, which is intersected by the symmetry plane, is provided with a thickness that is greater than a thickness provided in an opposite portion of the second annular part opposite to the thick portion, said opposite portion being intersected by the symmetry plane and extending toward the upper annular end from a determined lower end defined at a height identical to the height hs2 at the first point. This opposite portion is typically the point in the symmetry plane on the first line at height hs2.

Optionally, the thickness profile of the gripping portion is such that the average thickness of the gripping portion is less than a thickness measured in the symmetry plane in a specific region of the second annular part adjacent to the first point and longitudinally distant from the upper annular end. Optionally, the specific region has an area of at least 1 or 2 $cm^2$, preferably at least 5 $cm^2$. The specific region may be at least partly defined by the thick portion. The thick portion typically extends from the first point toward the annular upper end, the thick portion and the opposite portion having substantially a same longitudinal extension.

Optionally, the determined annular line is a continuously rounded annular line.

According to a particular feature, the following relation is verified:

$$(ds1-ds2)\geq 2 \text{ mm, preferably } (ds1-ds2)\geq 4 \text{ mm.}$$

In a particular embodiment (ds1−ds2)/D≥2.0%, preferably (ds1−ds2)/D≥2.5%. In a particular embodiment (ds1−ds2)/D≤10.0%, preferably (ds1−ds2)/D≤5.0%, where D is the greater outer diameter of the bottle.

In the symmetry plane, it is preferred that the recesses of the gripping portion be significantly marked in the radial direction. Accordingly the following relations are preferably satisfied:

$$ds2/D\leq 40\%, \text{ preferably } ds2/D\leq 35\%,$$

$$ds2/D\geq 25\%, \text{ preferably } ds2/D\geq 25\%,$$

$$ds1/D\leq 38\%, \text{ preferably } ds1/D\leq 33\%, \text{ and/or}$$

$$ds1/D\geq 27\%, \text{ preferably } ds1/D\geq 23\%.$$

With such specific decrease in section at the gripping recess (at the second point in the annular recess), there is increased adaptation for placement of at least one finger against or below an abutment region including the thick portion.

According to a particular feature, the thickness ratio of the thickness in the specific region to a minimum thickness in the gripping portion is 1.1:1 to 1.9:1. The thickness ratio of the thickness measured in the specific region to the average thickness in the gripping portion may be 1.05:1 to 1.3:1. With such profile of thickness, plastic material can be saved without impact for the resistance to vertical load. Plastic can be especially saved in a region diametrically opposite to the uppermost segment of the annular line. Such ratio may be obtained when only measuring thickness in the symmetry plane, on same side of the gripping portion.

According to a particular feature the thickness ratio between the thick portion and the opposite portion is 1.05 to 1.30, preferably 1.10 to 1.25. According to a particular feature, the thickness ratio between the thickness at second point and the thickness at first point is 1.05 to 1.30, preferably 1.10 to 1.25.

According to a particular feature, the annular line is tilted with an angle of 10 to 25 or 30°. With such configuration, the annular line may be circular or almost circular, which is advantageous to shorten the perimeter of the annular line, without need for a too recessed region in the bottle (this corresponds to optimal compromise to achieve improved top load resistance without impairing the grasping or adding too much plastic material).

According to a particular feature, the first annular part tapers from the lower portion and is longitudinally curved in an arched manner, the first annular part having a longitudinal extension lower than a longitudinal extension of the second annular part at least at one side of the gripping portion opposite to said maximally recessed area. With such configuration, the tapering may be very progressive: as a result, there is no particular need to increase thickness above the lowermost segment (and thus a reduction of thickness can be more significant in this area of the second annular part).

According to a particular feature, the side wall has a symmetry plane that includes the first (central) axis and intersects the determined annular line at two opposite points located at a same height (such height measured parallel to the first axis from the support plane).

This symmetry axis thus divides the side wall into two symmetrical halves and defines two opposite parting lines: a first parting line having a first thickness profile and a second parting line having a second thickness profile. The first thickness profile and the second thickness profile each have locally a maximum, respectively corresponding to the maximally recessed area and a less recessed area (defined around the lowermost segment). Because of such thickness profiles, the average thickness of the gripping portion is significantly lower than a thickness measured at the annular line. Maximum difference in thickness in the gripping portion may be 50 μm to 400 μm.

Of course, the wording "thickness profile", here for the tubular side wall, should be understood as the profile of thickness with respect to the longitudinal dimension (i.e. with respect to the height measured along the central axis).

In various embodiments of the bottle of the invention, recourse may optionally also be had to one or more of the following dispositions:

- the second annular part is connected to the shoulder at a substantially circular junction, which is perpendicular to the first axis. With such continuously rounded configuration, top load resistance is increased as compared to bottles having a shoulder with angles or elongated in a horizontal plane.
- the gripping portion extends around the first axis with such a geometrical shape that the first axis forms an intersection between a symmetry plane dividing the gripping portion into two symmetrical halves and a median plane perpendicular to the symmetry plane and dividing the gripping portion into a first C-shaped portion (provided with the first parting line that preferably separates two halves of the first C-shaped portion) and a second C-shaped portion (provided with the second parting line that preferably separates two halves of the second C-shaped portion).
- at an intersection between the second annular part and the symmetry plane, a rounded arc is defined with a radius of curvature R, which satisfies the following relations:

$$1/10<R/H1<1/6$$

$$6 \text{ mm}\leq R\leq 20 \text{ mm}$$

where H1 is height of the gripping portion. Such radius of curvature is a minimum radius of curvature for the first parting line and there is a single recess in the first parting line. The gripping portion may have a minimum height greater than 36 mm.

- the first C-shaped portion comprises the uppermost segment and has a profile of thickness with a first progressive reduction of thickness in a first sloped section between the uppermost segment and a first area located at a longitudinal distance of 30 mm below the uppermost segment.
- the second C-shaped portion comprises the lowermost segment and has a profile of thickness with a second progressive reduction of thickness in a second sloped section between the lowermost segment and a second area located at a longitudinal distance of 30 mm above the lowermost segment.

the thickness in the second area is preferably less than thickness in the first area, due to a greater decrease in thickness. Advantageously, the decrease in thickness significantly reduces average thickness of the gripping portion.

the second annular part of the gripping portion has a maximally sloped region where a first slope is formed at the first line (the first slope thus being defined in the symmetry plane) by the tapering of the second annular part, the first slope being at least 15 mm long and having a first general direction forming an acute angle with a median plane perpendicular to the symmetry plane and including the central axis.

the first C-shaped portion has a middle parting line intersected by a first median plane (the symmetry plane) and defining the maximally recessed area, the first C-shaped portion comprising in the middle parting line a first slope formed by the tapering of the second annular part, the first slope being at least 15 mm long and having a first general direction forming an acute angle with a second median plane (plane perpendicular to the symmetry plane and including the central axis).

the acute angle is between 12 degrees and 30 degrees. With such angle and such elongated vertical extension of the gripping portion, the bottle has an attractive design in an upstanding position with progressive transition between the shoulder and the determined annular line on the one hand and there is no need for excessively reinforcing the gripping portion by a too significant increase in thickness or use of ribs in such maximally recessed area on the other hand. Besides, the angle of the slope does not cause significant deviation for the flow of product to be poured.

the first general direction intersects the second median plane in an interior volume defined by the bottle, preferably at least 15 mm above a base defined by the bottom wall.

the second C-shaped portion defines a second slope at the opposite from the first slope in the second annular part, the second slope being at least 15 mm long and having a second general direction forming with the second median plane an angle lower than the acute angle; with such arrangement, the first slope is immediately perceived as more pronounced than the second slope, which helps for intuitively finding optimal hand position with thumb (or index) in the maximally recessed area.

the second general direction intersects the second median plane substantially at a bottom wall of the bottle or outside an interior volume defined by the bottle.

the maximally recessed area is part of a determined peripheral annular recess having a minimally recessed area at the lowermost segment, the determined peripheral annular recess being preferably deprived from any relief (such arrangement is of interest when the gripping portion is covered by a label, for example a shrink wrap, in order to prevent non-esthetical wrinkles).

the determined annular line is comprised in a single virtual plane and may have a single curvature (i. e. without any inversion in the curvature).

the determined annular line has a generally circular shape with a continuous rounding, the determined annular line having a diameter inferior to an outer greater diameter of the lower portion of the side wall. A center of the annular line is thus laterally shifted relative to the first axis. With such configuration, the gripping portion is deprived from panel segments and there is a single maximally recessed area. More generally, it is understood that the annular line is continuously rounded (and not necessarily circular). With such arrangement, the gripping is facilitated for the user.

the following relation is satisfied:

$$\frac{1}{5} < H10/D10 < \frac{1}{2}$$

where D10 and H10 are respectively diameter and height of the determined annular line, the height of the determined annular line being measured parallel to the first (central) axis.

the single plane deviates from 11 to 28°, preferably from 17 to 24°, as compared to a plane perpendicular to the first (central) axis.

the determined annular line extends symmetrically around a second axis that intersects the first (central) axis (below the single plane matching with the determined annular line) to define a pronounced acute angle of 17 to 24° between the first (central) axis and the second axis.

the second annular part has a shorter height measured parallel to the first (central) axis at a determined side along the maximally recessed area (at the first parting line) and has at the determined side a longitudinal outer profile provided with a maximal radial extension measured perpendicularly to the first (central) axis, the ratio between the maximal radial extension and the shorter height being comprised between 1:8 and 2:5. With such shape at the first parting line, the curvature is quite progressive and there is no need to keep a maximal thickness near the shoulder.

the following relation is satisfied:

$$\frac{1}{8} \leq EXT/D \leq \frac{1}{4}, \text{ preferably } \frac{1}{8} \leq EXT/D1 \leq \frac{1}{4}.$$

where EXT is the maximal radial extension in the second annular part at the determined side, D is defined above and D1 is a greater outer diameter of the lower portion of the side wall. In a preferred embodiment EXT is the difference between D/2 and ds2. Accordingly, the transition between the maximally recessed area and the area with the maximal perimeter is progressive and the reduction of the interior volume due to the gripping portion is limited. This is also advantageous to define a circular bulge in the lower portion at a significant longitudinal distance from the bottom wall without unduly decreasing the interior volume of the bottle.

the following relation is satisfied:

$$\frac{1}{3} \leq H1/H \leq \frac{3}{4}$$

where H1 is height of the gripping portion and H is height of the bottle, measured between the support plane and an opening defined at an upper face of the neck. The significant height proportion of the gripping portion is advantageous to provide a greater radius of curvature at the maximally recessed area (thus minimizing risk of cracks) and for improved perception of the bottle (perception of a hip in a swaying state when the profile defined by the maximally recessed area is considered by the user's eye).

the gripping portion has for example a minimum height greater than 36 mm when total height of the bottle is comprised between 110 than 160 mm and may be greater than 60 or 80 mm when total height is greater than 160 or 200 mm, respectively; the gripping portion thus can be provided with progressive curvatures above and below the single recess.

the following relation is satisfied:

$$0.35<H1/(H2+H8+H5)<0.9$$

where H1 is height of the gripping portion, H2 is height of the base, H8 is height of the side wall, H5 is height of the shoulder (each eight being measured parallel to the first axis).

the following relation is satisfied:

$$0.45\leq H1/(H2+H8)\leq 0.8$$

where H1 is height of the gripping portion, H2 is height of the base, H8 is height of the side wall.

- the shoulder defines an outer diameter substantially equal to the outer diameter defined by the lower portion of the side wall (such feature is of interest for grouping the bottles in a wrapped pack without significant gaps near the respective necks). Such kind of bottles is suitable for mass production.
- the neck is narrower than the base and adapted to receive a closure, the neck being preferably provided with a thread.
- the bottle comprises a decorative label extending below the neck and preferably above the base, in an upstanding position of the bottle, in order to cover the side wall, the side wall having a peripheral outer face in direct contact with the decorative label, wherein the side wall is deprived from any projection protruding from the peripheral outer face.
- the decorative label is a one piece plastic sleeve that includes a shrink film annularly secured to the second annular part and to the shoulder, the plastic sleeve being in contact with the first annular part at least in an annular area distant from the determined annular line; with such arrangement with attachment to the shoulder, the plastic sleeve cannot slip downwardly.
- the lower portion tapers toward the bottom wall and comprises an annular surface uncovered by the decorative label and having a height of at least 15 mm. Typically, the lower edge of the label is positioned on a circular bulge or at a lower end of a cylindrical portion immediately above the tapering portion; with such configuration, the decorative label is better integrated (when combining a circular cross section in the lower portion and such a tapered lower portion) than when using another kind of shape for the body. In contrast, with a decorative label having a lower edge located in the middle of a cylindrical wall, the final consumer will immediately think that the decorative label has not the expected size or position. This is especially true when the side wall is opaque (this is typically the case in bottles for flowable dairy product).
- the bottle is higher than wide and has a height H verifying the relation:

$$2\leq H/D\leq 4$$

where D is the greater outer diameter of the bottle.

A further purpose of the invention is to provide a pack of bottles easy to be manipulated in a supermarket (before exposure of the containers by the operators and thereafter by the final consumer) and resistant with respect to top load while facilitating handling of the individual bottles.

To this end, embodiments of the present invention provide a food pack comprising a plurality of thermoplastic bottles according to the invention, each of the bottles being filled with a drink and sealed by a closure that covers the neck, the bottles being arranged in at least one row and wrapped by a peripheral wrap.

In the wrapped state, the shoulders are in contact with each other.

As each bottle is at least twice higher than wide, this also advantageously minimizes the radial bulk of the bottles that may be easily grouped in such compact pack.

It is also provided, according to the invention, a use of a bottle according to the invention for containing a beverage, such as a carbonated or non-carbonated, alcoholic or non-alcoholic beverage, for example a flavoured or un flavoured still or sparkling water, or a dairy product, preferably a flowable fermented dairy composition such as a yoghurt composition (dairy drink) having a weight not inferior to 50 g and not superior to 2000 g, typically not inferior to 150 g and not superior to 1500 g. The shape and size of the gripping portion is particularly user-friendly while the arrangement of the bottle is very compact when containing a dairy product such as a yoghurt composition or similar dairy flowable product having a weight comprised between 150 and 1000 g.

Other features and advantages of the invention will become apparent to those skilled in the art during the description which will follow, given by way of a non-limiting example, with reference to the appended drawings.

BRIEF DESCRIPTION OF THE DRAWINGS

In the various figures, the same references are used to designate identical or similar elements.

DETAILED DESCRIPTION OF EMBODIMENTS

Figure 1:
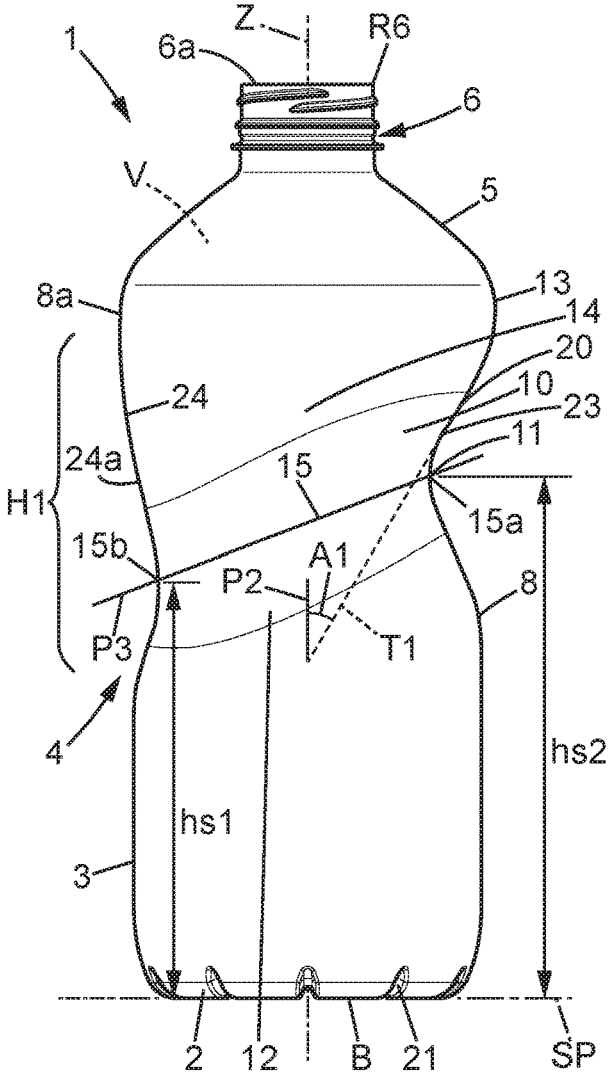
FIG. 1 is a front view of a first embodiment of a bottle according to the invention.
Figure 2:
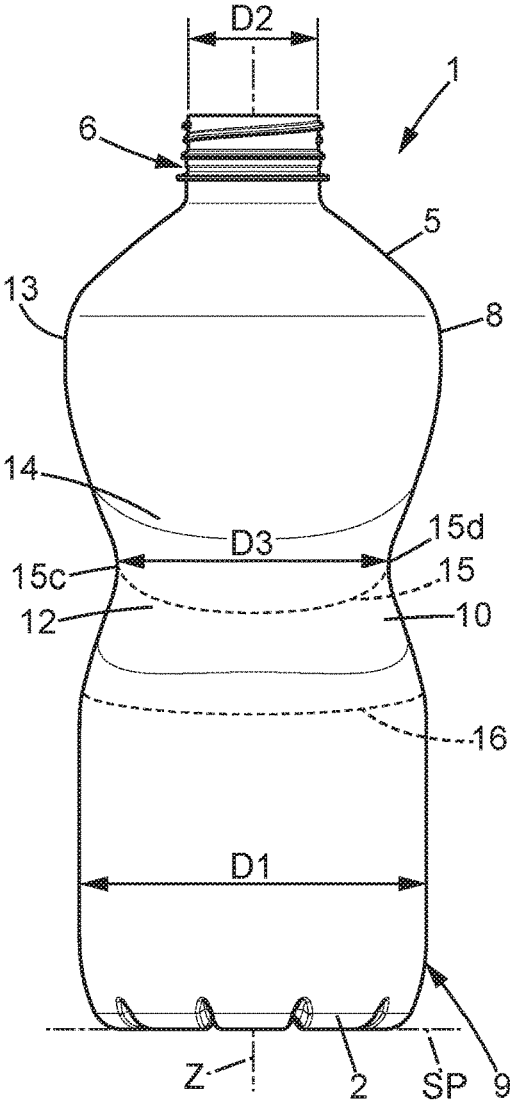
FIG. 2 is a side view of the bottle shown in FIG. 1.

FIGS. 1 and 2 show from the front and the side a bottle 1 made of plastic material, especially thermoplastic material such as PET, PE (typically HDPE), PP, or similar stretchable material, intended to contain from 50 mL to 2000 mL, for example roughly 1 litre of beverage, such as still water or similar amounts of flowable dairy product. More generally, the bottle 1 may be made of any suitable plastic material, possibly with at least one additional layer.

The bottle 1 extends longitudinally along a first axis Z, which is a vertical central axis. It has, from its base B to its top, a bottom wall 2, a lower portion 3, a gripping portion 4, a shoulder 5 defining an upper portion, a neck 6 provided with a ring-like face R6 defining a pouring opening 6*a* (single opening of the bottle 1). The neck 6 may be provided with a thread or other suitable attachment means for a cap C or any suitable closure. The ring 7 is here intended to receive a screwable top (not shown in the figures). However, any type of stoppering element may of course be used. For example, the closure may be defined by a metallic foil or by a suitable flexible cover (possibly reinforced by an additional reinforcing layer). The shoulder 5, connected to the neck 6, has a circular section. The lower portion 3 is also circular and defines a greater outer diameter D1 of the bottle 1. An outer diameter of the shoulder 5 may be optionally substantially equal to this diameter D1. Such diameters can be equivalent to the greater outer diameter D of the bottle. The opening 6*a* may be provided with an interior diameter greater than 25 or 28 mm. A wide mouth is preferred for easy drinking. The outer diameter D2 at the top of the neck 6 may be equal to or greater than 30 mm but inferior to 40 mm. Of course, the diameter D1 is significantly greater than the diameter D2 (for example at least twice as long as such diameter D2).

The side wall 8 of the bottle 1 is here defined by:

- the lower portion 3 adjacent to the base B and which extends symmetrically around the first axis Z; and
- the single gripping portion 4, which is of annular shape, and is provided with an annular recess 10.

The base B, the side wall 8 and the shoulder 5 define a hollow body 9 that is typically obtained by stretch-blow molding a thermoplastic preform. EBM (extrusion blow molding), IBM (injection blow molding) and ISBM (injection stretch blow molding) may be options for forming the body 9 from a paraison or preform. ISBM is preferred to obtain transparent bottles 1. The hollow body 9 can be stretched with a stretching ratio comprised between 5 and 15.

The side wall 8, less rigid than the neck 6 (typically not stretched), extends longitudinally around the first (central) axis Z from an upper end 8*a* adjacent to the shoulder 5 to a lower end 8*b*. The lower end 8*b* may be close to the planar bearing portion (or support plane SP) defined by bottom wall 2. Alternatively, the base B may be provided with a skirt of significant height connected to the lower end 8*b*. In any case, the annular recess 10 in the gripping portion 4 extends substantially in the middle of the body 9 (the wording "substantially in the middle of the body" is conventionally used for thin-walled containers and is to be understood as meaning at about a half height of the body 9 and more generally in a middle part of the body 9 that may represent about 50% of the total height of the body 9). For comfortable pouring of the liquid with a bottle 1 of at least 300 mL, it is preferable if the gripping portion 4 is significantly distant from the base B, and preferably at a lower distance from the neck 6 than from the bearing portion at the base B. The annular recess 10 may also be located entirely below three quarters of total height H of the bottle 1.

Figure 3:
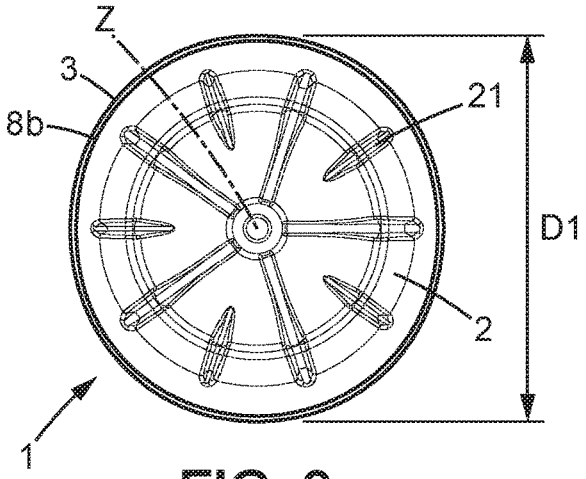
FIG. 3 is a bottom view of the bottle of FIG. 1.
Figure 13:
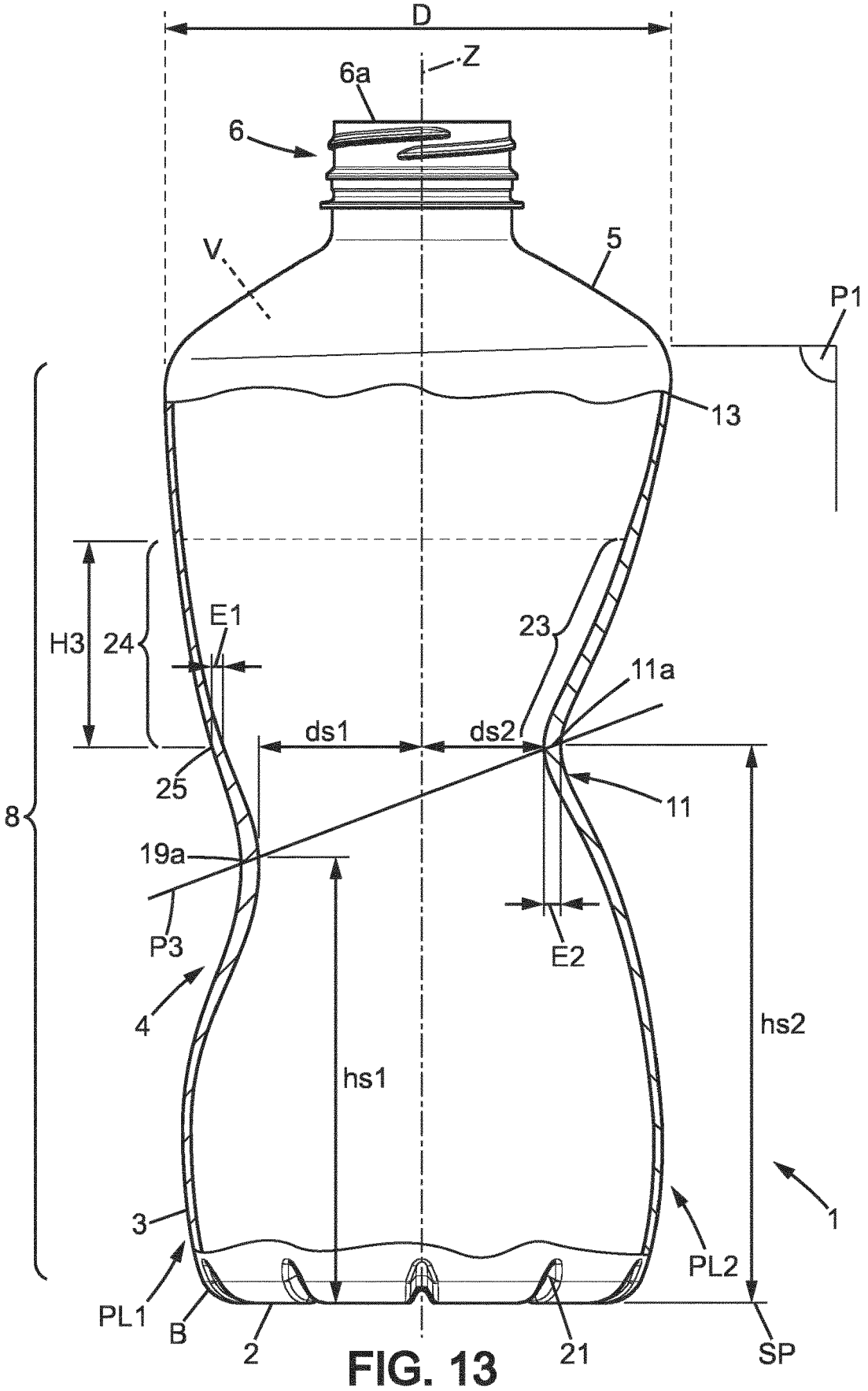
FIG. 13 illustrates a cross section of a bottle in accordance with the invention, with detailed variation of thickness in the side wall.

In the first embodiment shown in FIGS. 1-3 and in the embodiment shown in FIG. 13, the bottle 1 is formed from a single piece of plastic material, PET PP or PE for example, which is shaped by heat blow-molding a paraison or preform in a mold. Heat blow-molding makes it possible to stretch the plastic material biaxially and to provide it with rigidity. Heat blow-molding also makes it possible to reduce the thickness of the wall of the body 9 considerably in relation to the thickness of the wall of the paraison or preform. This small thickness of the walls of the body of the bottle, which may be of the order of 150 to 350 micrometers depending on the zone considered, is important for achieving a saving in material and therefore in weight. In the side wall 8 (i.e. not in the shoulder 5 and not in the bottom wall 2), the thickness may be typically be superior or equal to 220 μm or 240 μm or 250 μm.

As illustrated in FIG. 3, the bottom wall 2 may be provided with radial grooves 21 and its average thickness is a little greater than in the lower portion 3 in order to reinforce this part which has to transmit the weight of the bottle 1 and of any bottles stacked above it on a surface which may be more or less plane and regular. Other more or less complex shapes for the base B are of course possible, in particular if the bottle 1 is for a carbonated drink and has to withstand great internal pressures, even when it is not resting on its bearing portion.

The lower portion 3 and/or the gripping portion 4 and/or an upper portion of the body 9 optionally has reinforcing reliefs (not shown), here recessed in relation to the external profile of the lower portion 3 and/or the gripping portion 4 and/or an upper portion. These reinforcing reliefs can take various forms, such as for example undulating grooves or annular flutes arranged horizontally, that is to say located in transverse planes in relation to the central axis (first axis Z) of the bottle 1, and/or arranged according to titled plans. When present, the reliefs make it possible to support the internal pressure of the bottle 1 and also provide longitudinal elasticity in order to allow an increase in the internal pressure of the liquid and therefore resistance to vertical crushing. In an embodiment the body 9 presents two tilted deep grooves in the gripping portion 4, preferably at distance from the determined annular line 15 (it may be same or similar tilting as the determined annular line for such deep grooves). Such arrangements provide particularly suitable mechanical resistance as well as usage comfort.

Preferably when the bottle 1 is obtained by ISBM or similarly blow molded with a stretching, the gripping portion 4 may be provided with such reinforcing reliefs, except in the annular recess 10 where a maximally recessed area 11 is defined.

The bottle 1 in an empty and unclosed state may optionally be lighter than 30 or 35 g, even for a capacity of about 900 mL or 1 L. Of course, for a capacity inferior or equal to 500 mL, the bottle 1 may optionally be lighter than 15 g.

Referring to FIGS. 1 and 13, the bottle 1*a* is provided with opposite lines PL1, PL2, defined in a symmetry plane P1 and having each a particular concavity. The gripping portion 4 extends at different distances ds1, ds2 from the central axis Z. Regarding the first line PL1, it can be seen in FIG. 13 that the minimal radial distance ds1 between the first line PL1 and the central axis Z is defined at a first point 19*a*, at a height hs1, which is inferior to height hs2 where the opposite second line PL2 defines a minimal distance ds2 between the side wall 8 and the central axis Z. Additionally, at a given point 25 of the first line PL1 defined at same height as the height hs2 of the second point 11*a*, the gripping portion 4 has a thickness E1 that is lower than the thickness E2 in the second point 11*a*.

With such configuration, a gripping portion 4 defining a circumferential recess may be obtained with an advantageous shape, offering possibility for some fingers of same user's hand to be placed in contact with the first point 19*a* and in contact with the second point 11*a*.

Now referring to FIGS. 1-2, 5 and 8, it can be seen that the gripping portion 4 essentially comprises a first annular part 12 tapering toward the upper end 8*a* and a second annular part 14 tapering toward the lower end 8*b*. The gripping portion 4 has a determined annular line 15 that defines a peripheral intersection between the first annular part 12 and the second annular part 14. Such determined annular line 15 is not undulated and is here defined in a single virtual plane P3 (illustrated in FIG. 1 in particular). Specifically, the determined annular line 15 is tilted with respect to the support plane SP defined by the base B.

Figure 5:
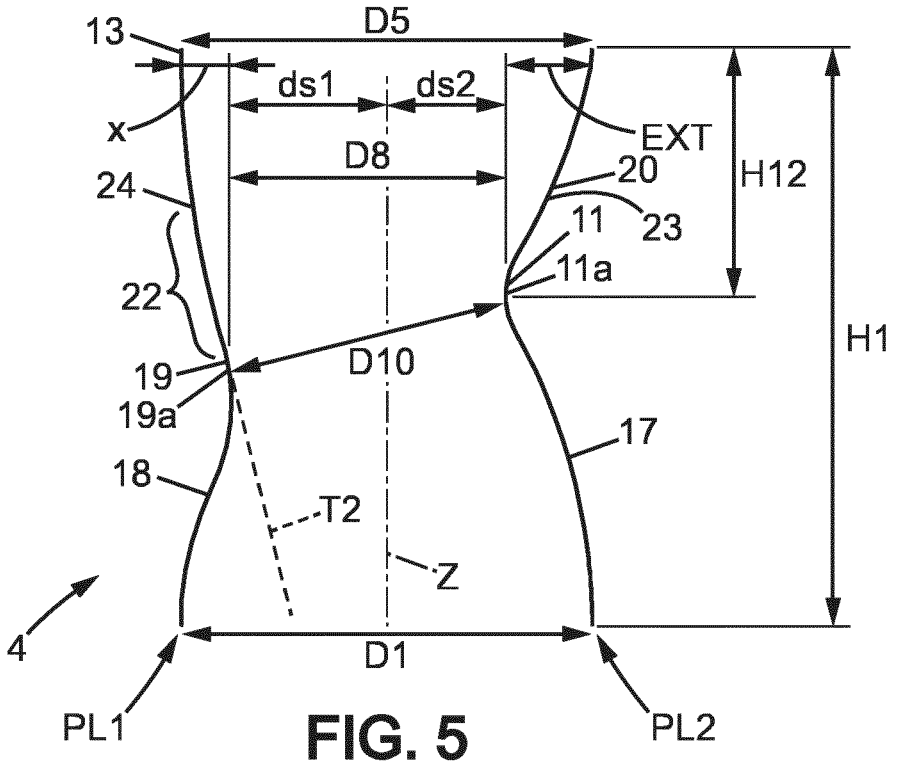
FIG. 5 is a vertical section showing opposite profiles of the gripping portion in a bottle in accordance to the invention.

The determined annular line 15 is continuously rounded and preferably circular. The diameter D10 defined by this generally circular line may be inferior to the outer greater diameter D1 of the lower portion 3, as illustrated in FIG. 5. Preferably, the following relation is satisfied:

$$\frac{3}{4} < D10/D1 < \frac{9}{10}$$

Accordingly, the diameter D10 is advantageously not too reduced, thus making the design of the bottle 1 more attractive on the one hand and limiting the decrease of the radius of curvature R in the maximally recessed area 11 on the other hand (so that average thickness of the gripping portion 4 may remain relatively low).

Due to the tilt angle TA (FIG. 6), the annular line 15 comprises at a determined side an uppermost segment 15*a* and at the opposite a lowermost segment 15*b*. Because of the maximally recessed area 11 located at the determined side, the uppermost segment 15*a* is closer radially to the first (central) axis Z than the lowermost segment 15*b*. As illustrated in the cross section of FIG. 5, the second annular part 14 of the gripping portion 4 is provided with a maximal radial extension EXT at the determined side. Such maximal radial extension EXT may be at least 4 or 5 mm higher than the radial extension x defined at the opposite side of the second annular part 14 (which means that the difference ds1−ds2 may be at least equal to 4 or 5 mm due to the circular shape at junction with the shoulder 5). Optionally such difference (EXT−x=ds1−ds2) may be comprised between 4 mm and 14 mm. Between the segments 15*a* and 15*b*, more precisely between the second point 11*a* and the first point 19*a* that are intersected by a symmetry plane P1 of the side wall 8, there is a radial distance D8 lower than the diameter D10. Such distance D8 is superior to the diameter D2. It can be seen that the distance D8 corresponds to a sum of the radial distances ds1 and ds2 respectively measured in the symmetry plane P1 (plane of the section shown in FIG. 5) between the first (central) axis Z and the points 19*a* and 11*a*. The first point 11*a* defines the point closest to the first (central) axis Z in the side wall 8 due to the maximally recessed area 11.

Figure 7:
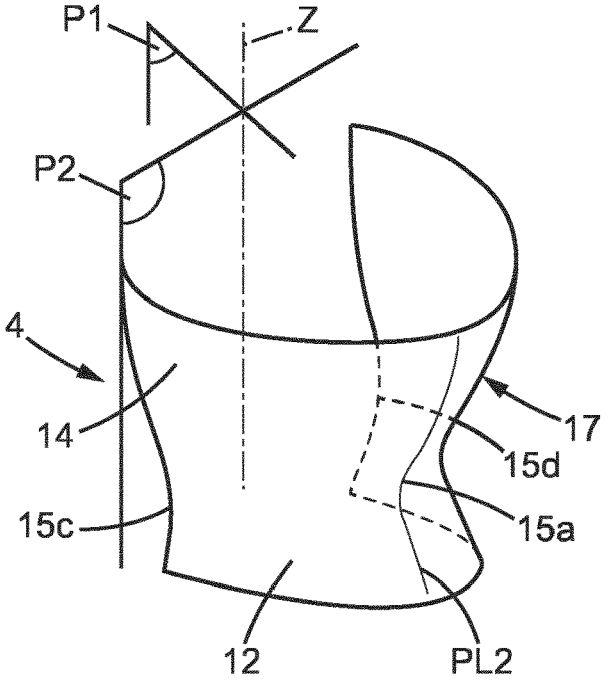
FIG. 7 is a perspective view of a first C-shaped portion of a gripping portion partially shown in FIG. 6, such view illustrating the maximally recessed area of the bottle.

Referring to FIGS. 2 and 7, the side wall 8 also has a median plane P2 including the first (central) axis Z and intersecting the determined annular line 15 at two opposite points 15*c*, 15*d* located at a same height (measured parallel to the first (central) axis Z) from the support plane SP. As compared to the greater outer diameter D1, the distance D3 defined between these points 15*c*, 15*d* may be inferior of 10-30% and is inferior to the diameter D10.

Figure 4:
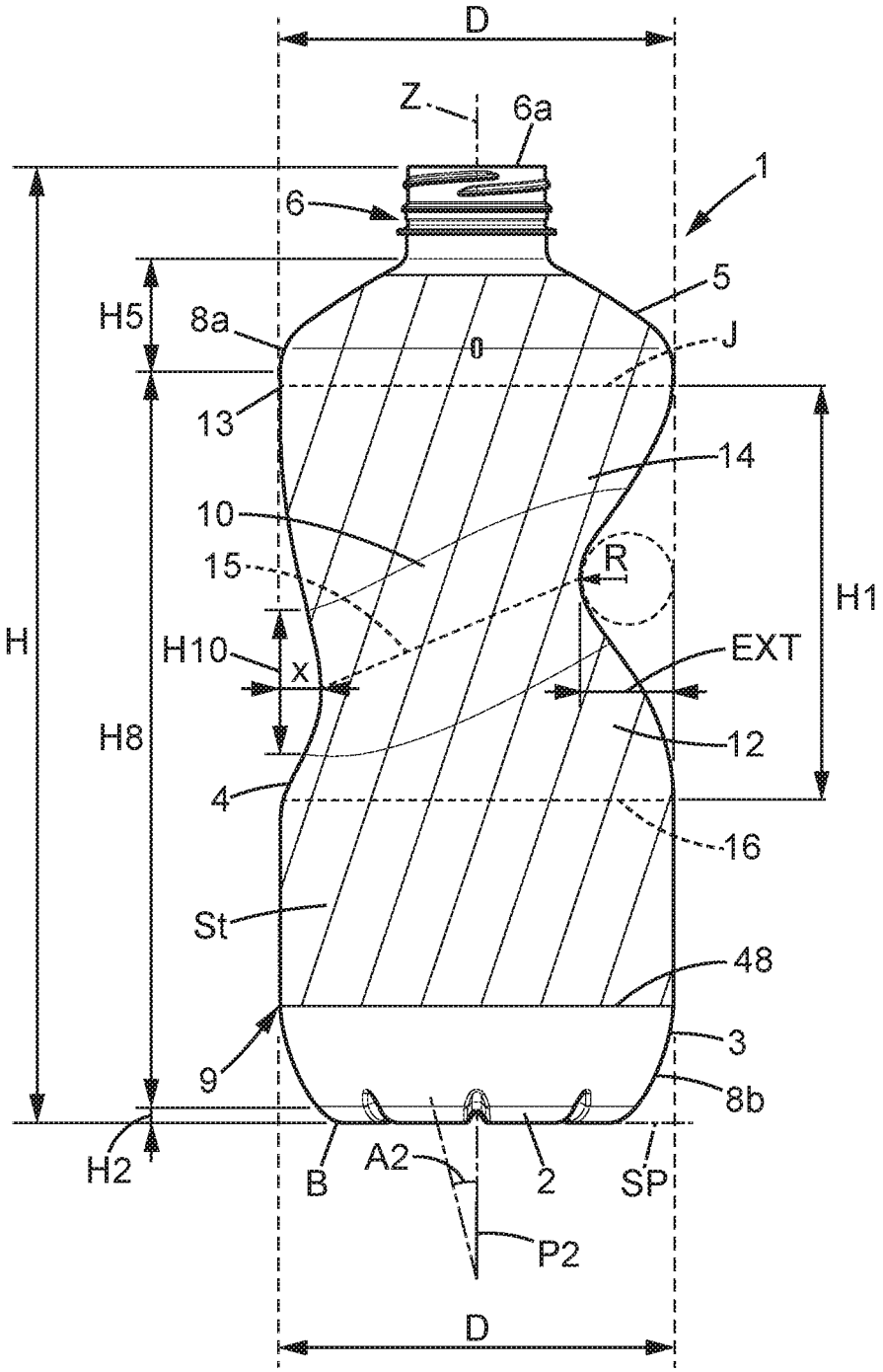
FIG. 4 is a front view of a second embodiment of a bottle according to the invention.

The first annular part 12 is tapering toward the upper end 8*a* from a substantially circular junction with the lower portion 3. Such junction for interconnection between the lower portion 3 and the first annular part 12 is here defined at a circular peripheral intersection line 16 that is perpendicular to the first axis Z, as illustrated in FIG. 4 in particular. The lower portion 3 may be at least partly cylindrical, provided with one or more bulges and/or may be longitudinally curved with a tapering toward the bottom wall 2.

Optionally, the side wall 8 may be provided with an upper portion distinct from the gripping portion 4 and of substantially cylindrical shape, extending between the annular part 14 and the shoulder 5.

Figure 6:
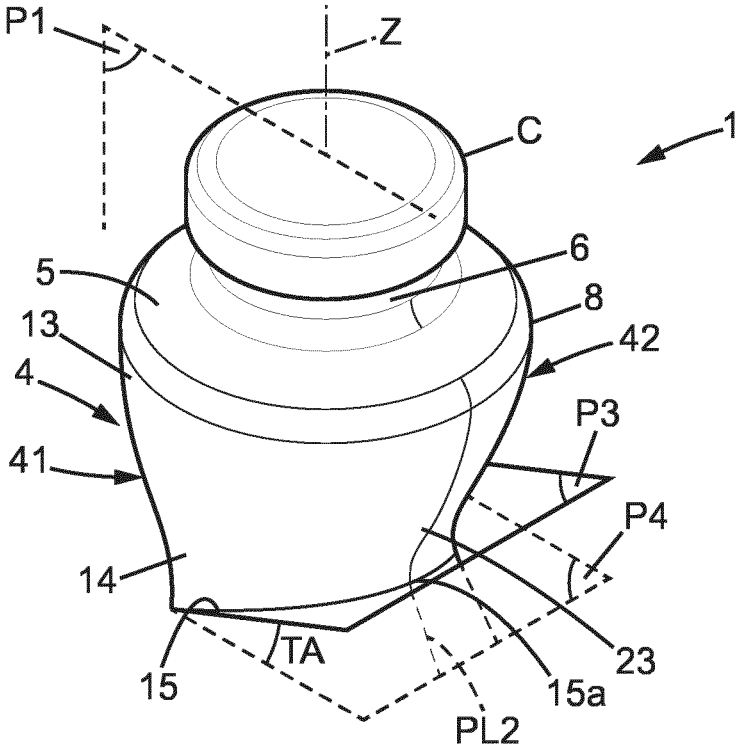
FIG. 6 is a perspective view of an upper part of a bottle in accordance with a third embodiment of the invention.

Referring to FIGS. 1 and 6, it can be seen that the annular line 15 is located at a height progressively increasing from the lowermost segment 15*b* toward the uppermost segment 15*a*. The lower height hs1 at the lowermost segment 15*b*, as shown in FIG. 1, is here measured in the symmetry plane P1 that corresponds to a median plane of the gripping portion 4, dividing the gripping portion 4 into two symmetrical halves 41, 42 (as shown FIG. 6). The greater height hs2 at the uppermost segment 15*a* is more than half of the total height H of the bottle 1. The height hs2 may optionally be 9 to 40 mm greater than the height hs1.

The first annular part 12 is longitudinally curved in an arched manner, in order to progressively taper from the lower portion 3 to the annular line 15. Because of the tilt angle TA, the first annular part 12 has a longitudinal extension lower than a longitudinal extension of the second annular part 14 at least at one side of the gripping portion 4 opposite to the determined side.

The second annular part 14 is now described in connection with FIGS. 1 and 4-7. The second annular part 14 is here connected to the shoulder 5 at a circular junction J. The second annular part 14 is tapering downwardly from an annular upper end 13 that is typically circular and not tilted. While FIG. 4 shows a junction J that immediately connect the shoulder 5 of height H5 to the gripping portion 4 of height H1, it is understood that the junction J may also correspond to an intermediate annular portion (cylindrical portion for instance) of significant height (but preferably lower than height H1) between the shoulder 5 and the gripping portion 4.

The shoulder 5 may extend symmetrically around the first (central) axis Z. This first (central) axis Z forms an intersection between the symmetry plane P1 and a median plane P2 perpendicular to the symmetry plane P1. From the junction J, the second annular part 14 is tapering in different manner, depending on the side with respect to the second median plane P2. Indeed, such second median plane P2 divides the gripping portion 4 into a first C-shaped portion 17 and a second C-shaped portion 18. Here, it is understood that "C-shaped" means that the portion 17 or 18 is substantially half-round profiled in a cross section perpendicular to the first (central) axis Z.

In the first C-shaped portion 17, there is a first parting line PL1 (middle or median line) at the intersection with the symmetry P1. Such symmetry plane P1 defines two opposite parting lines PL1 and PL2 (as shown in FIGS. 5 and 13) for the gripping portion 4. The second parting line PL2 has a reduced radius of curvature R at the uppermost segment 15*a*. Indeed, the first C-shaped portion 17 has a middle intersected by the symmetry plane P1, where the maximally recessed area 11 is defined. At this maximally recessed area 11, the parting line PL2 forms a rounded arc and the corresponding radius of curvature R (FIG. 4) is typically inferior or equal to 20 mm but superior or equal to 6 mm.

Figure 10:
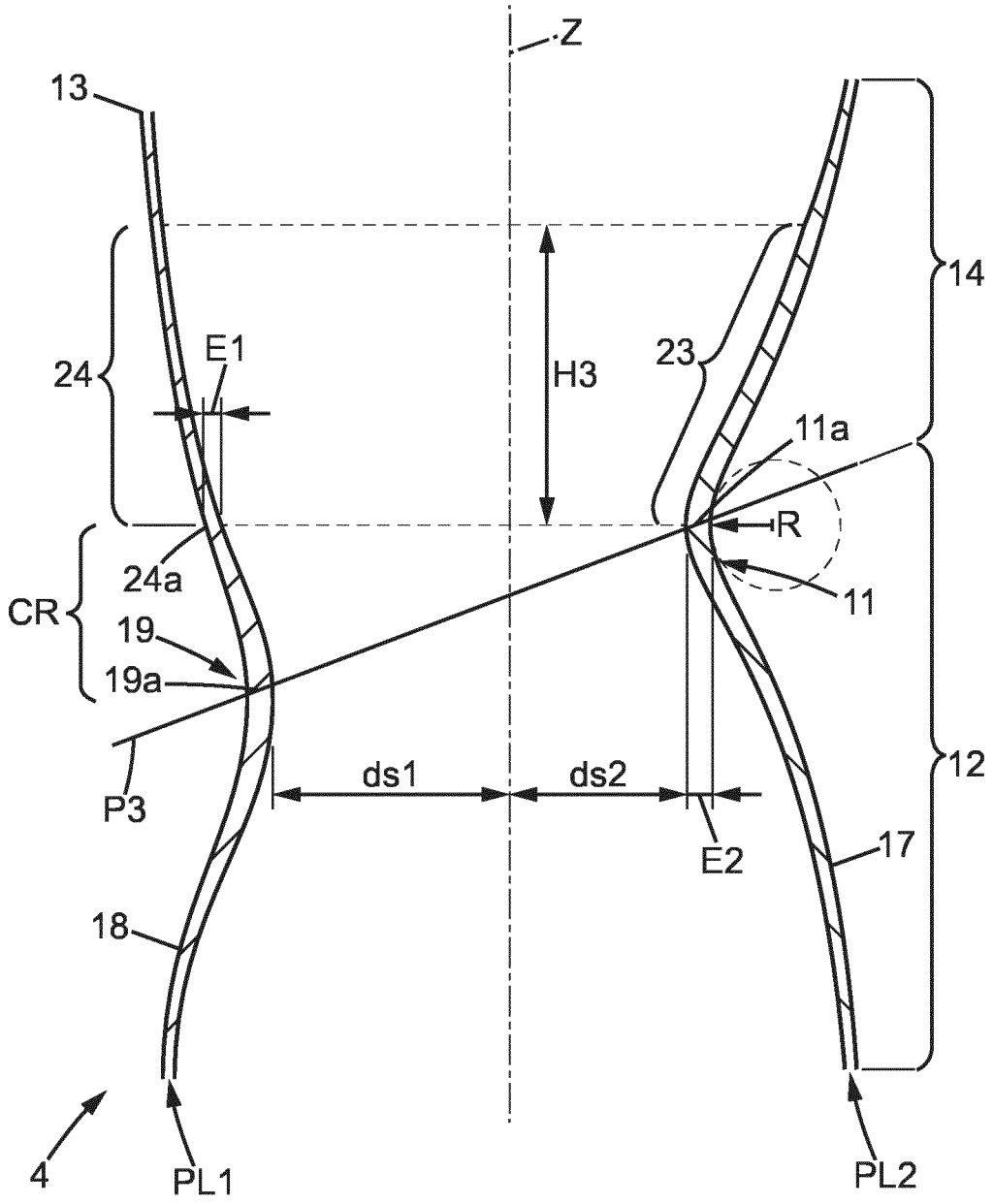
FIG. 10 is a view similar to FIG. 5, showing variation of thickness at opposite profiles of the gripping portion in a bottle in accordance to the invention.

More generally, it is understood that the radius of curvature R may be low because of the maximal radial extension EXT defined above the uppermost segment 15*a*. FIG. 10 (where thicknesses are exaggerated for purpose of illustration) shows that the radius of curvature R is typically inferior or equal to the radial distance ds2. The difference between the radial distances ds1 and ds2 is typically superior or equal to 2 mm, preferably 4 mm, preferably 5 mm. In order to provide a convenient reduction of size at the gripping portion 4, the tilt angle TA as measured in the symmetry plane P1 is not superior to 30° and the following relation may be satisfied:

$$0.5 \leq (ds1+ds2)/D1 \leq 0.8, \text{ preferably } 0.5 \leq (ds1+ds2)/D \leq 0.8.$$

The gripping portion 4 shown in FIG. 10 may be provided in bottles of small capacity, for example between 150 and 500 mL the above ratio may be typically less than 0.65. For greater capacities, the radial distances ds1 and ds2 are proportionally greater and the above ratio may be typically greater than 0.65.

As illustrated in FIGS. 6-7, the first C-shaped portion 17 is provided with a slope 20 defined in the first parting line PL1 adjacent the segment 15*a*. This slope 20, formed by the tapering of the second annular part 14, is at least 15 mm long and has a first general direction T1 forming an acute angle A1 with the median plane P2, as shown in FIG. 1. This acute angle A1 may be comprised between 12 degrees and 30 degrees. In order to limit reduction of the bottle volume at the gripping portion 4 and limit increase of thickness, having the angle A1 lower than 45° is advantageous because the radius of curvature R remains typically more than 10% of the height H1 of the gripping portion 4. The following relation may be satisfied:

$$1/10 < R/H1 < 1/6$$

It can also be seen that the first general direction T1 intersects the median plane P2 in an interior volume V defined by the bottle 1, preferably at least 15 mm above the base B.

Figure 8:
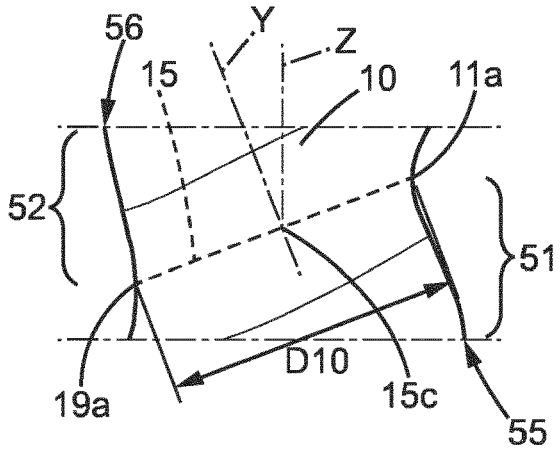
FIG. 8 is a detail front view of the annular recess extending along a tilted determined annular line.

The second C-shaped portion 18 defines another slope 22 at the opposite from the slope 20, i.e. in the second parting line PL2, as shown in FIG. 5. This second slope 22 is here at least 15 mm long and has a second general direction T2 forming with the median plane P2 an angle A2 lower than the acute angle A1. The angle A2 may be substantially the same as the tilt angle TA. Referring to FIG. 8, it is understood that the angle A2 is defined between the first (central) axis Z and the second axis Y (which is a central axis, and preferably a symmetry axis for the determined annular line 15).

As illustrated in FIG. 4, this second general direction T2 may intersect the median plane P2 outside the interior volume V defined by the bottle 1. Such intersection may also be substantially located at the bottom wall 2 of the bottle 1. It is thus understood that the slope 22 immediately above the lowermost segment 15*b* in the second parting line PL2 allows for a more progressive curvature than the slope 20 that extends above the lowermost segment 15*b*.

The height H1 of the gripping portion 4, which is greater than the diameter D1, may be at least equal to one third of the height H of the bottle 1. In combination with the tilted annular line 15 that locally minimizes the circumference of the bottle, this ensures more options for positioning the hand around the bottle 1. Here the perimeter part that is most suitable for the gripping may be essentially defined in the first C-shaped portion 17, along the virtual plane P3 as shown in FIG. 6. The height H1 of the gripping portion 4 is also not superior to 75% of the height H of the bottle 1 and the maximal radial extension EXT may be such that $$1/8 \leq EXT/D1 \leq 1/4, \text{ preferably } 1/8 \leq EXT/D \leq 1/4$$

Besides, the height H10 defined by the determined annular line 15 may represent a fraction of the diameter D10 of the annular line 15 at least equal to 0.2 and inferior to 0.5. Having such moderate radial extension EXT and such limited height D10 is advantageous to have a loss of volume less than 20 or 30%, preferably less than 15%, as compared to an equivalent bottle without any gripping portion (for the embodiment illustrated in FIGS. 1-2, such equivalent has a cylindrical side wall).

Referring to FIG. 5, the second annular part 14 of the gripping portion 4 is provided with a shorter height H12 at the determined side because of the tilt angle TA. At the second parting line PL2, the maximal radial extension EXT defined above the uppermost segment 15*a* may be more than one quarter or one third of the height H12. More generally, the ratio between the extension EXT and the height H12 is typically comprised between 1:8 and 2:5. The maximal radial extension EXT may be defined at an upper point of the second parting line PL2. Typically, as illustrated in FIG. 5, the shorter height H12 is measured parallel to the central axis Z between the second point 11*a* and the upper point (where the extension EXT is defined) of the second line PL2.

Besides, the distance D8 may be superior or equal to the shorter height H12 but inferior to the longer height of the second annular part 14.

Regarding the annular line 15, which defines a bottom line in the gripping portion 5 (bottom line of the annular recess 10), it deviates from the horizontal position by a tilt angle TA of less than 30° and typically greater than 10 or 15°. In a preferred embodiment, the plane P3 deviates from 11 to 28°, preferably from 17 to 24°, as compared to a plane P4 perpendicular to the first axis Z, as shown in FIG. 6. Such deviation corresponds to the tilt angle TA.

As illustrated in FIGS. 1 and 4-8, the determined side of the gripping portion 4, where the parting line PL2 extends, provides an improve visual impression. Furthermore it has been found that it is a better place where a thumb or an index has to be positioned. With such arrangement, the annular line 15 may be in contact with user fingers and the first annular part 12 defines a natural contact surface for the palm of the user hand (without impairing the natural position of the index and the thumb when grasping). Indeed, the tapering in the first annular part 12, especially at the determined side (along the second parting line PL2) may adequately correspond to the natural conformation of the palm when the hand is grasping the bottle 1 at the gripping portion 4. Even for small capacities, height hs2 (which is higher as compared to height at the lowermost segment 15*b*) is sufficient for placing the palm of the hand in close contact with the side wall 8 below the annular line 15, especially along the first annular part 12 and optionally along the lower portion 3.

It can be seen that the side wall 8 is deprived from any projection protruding from the peripheral outer face here defined by the lower portion 3 and the gripping portion 4. Referring to FIG. 4, the side wall 8 of the body 9 is adapted to be annularly covered by a decorative strip like label St, sticker or banderol, at least in the gripping portion 4. The decorative label St extends below the neck 6 and optionally above the base B in an upstanding position of the bottle 1, in order to cover at least the peripheral outer face the side wall 8. The lower edge 48 of the label St is preferably rectilinear (without undulations) and has a circular section in the wrapped state.

The lower portion 3 of the side wall 8 may be tapered toward the base B. A brand name or a similar pattern could be marked in this lower portion 3 when forming the body 9. With this arrangement, the lower edge 48 may extend at a significant distance from the base B and the height of the decorative label St is advantageously reduced, thus saving packaging material. Moreover, integration of the decorative label St is better when combining a circular cross section (at the lower edge 48) and such a tapered lower portion 3.

The decorative label St may be a single piece plastic sleeve that includes a shrink film annularly secured to the second annular part 14 and to the shoulder 5. This plastic sleeve 5 is also in contact with the first annular part 12 at least in an annular area distant from the determined annular line 15. Fixing of the strip St is performed in a known manner. The decorative label St may be conformed exactly like the shape of the gripping portion 4, due to the smooth curvature (without sharp angles or protrusions) in the side wall 8.

Figure 9:
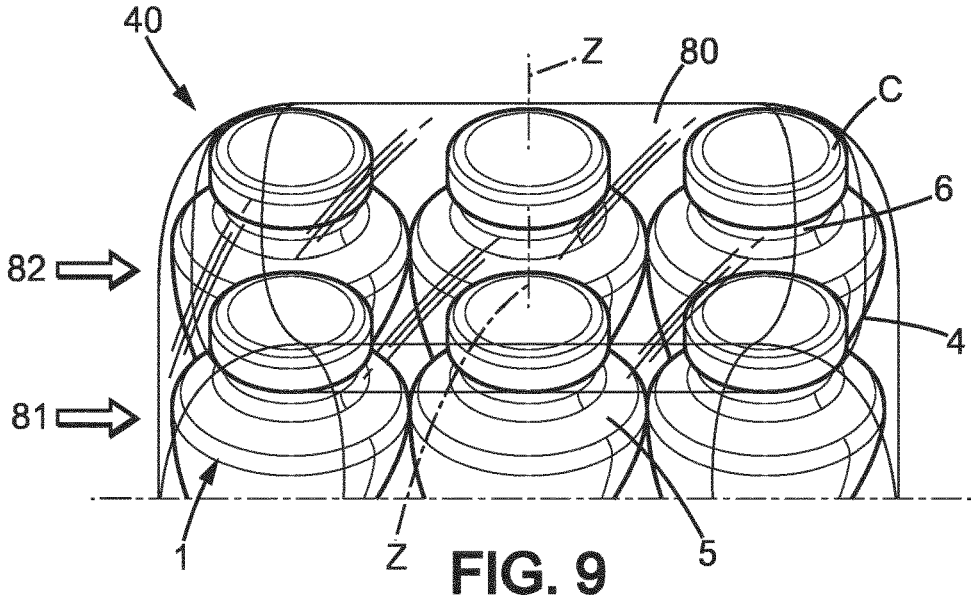
FIG. 9 is a perspective view of an upper part of a pack of the bottles shown in FIG. 6.

Such decorative label St is particularly well integrated when the height H1 of the gripping portion 4 represents a fraction of the height of the body 9 at least equal to 0.35 and inferior to 0.9. Here the height of the body 9 is equal to the sum of the following heights: height H2 of the base B, height H8 of the lower portion 3 and height H5 of the shoulder 5. Of course, the height of the shoulder 5 may vary. For instance, the shoulder 5 may be either substantially as high as or higher than the neck 6, as illustrated in the first embodiment shown in FIGS. 1-2, or such height H5 may be minimized as shown in FIGS. 4, 6 and 9.

In the illustrated embodiments, the height H1 represents a fraction of the cumulated height of the base B and the side wall 8 (i.e. H2+H8), which is at least equal to 0.45 and inferior to 0.8. When the height H1 is close to or bigger than half of this cumulated height below the shoulder 5:

- there is sufficient place for accurately positioning the palm of the hand with continuous contact below the annular line 15 (at the first annular part 12),
- while the second annular part 14 can taper with a sufficient radial extension EXT for facilitating the grasping and be progressively curved for top load resistance.

When a shrink wrap forming the label St is present as illustrated in FIG. 4, the smooth curvature is also advantageous to prevent wrinkles during shrinkage.

Now referring to FIG. 9, it can be seen a food pack 40 including several bottles 1, each filled with a drink (possibly milk or other dairy beverage). The bottles 1 are sealed by an appropriate closure that covers the neck 6. The bottles 1 are arranged in at least one row 81, 82 and wrapped by a peripheral wrap 80, preferably made of a thin film of plastic. Here, the shoulders 5 may be in contact with each other, while the necks 6 are significantly spaced from each other. The two illustrated rows 81, 82 are transversal in relation to each central axis (i.e. respective first axis Z). A transparent plastic wrap 80 may be used to have the bottle shape well perceived by the user, especially at all or part of the gripping portion 4. Alternatively, the bottles 1 are grouped in a cardboard packaging wrap 80 that allows at least a first bottle 1 of a row 81, 82 to be perceived, preferably by one or more lateral openings of the wrap 80. Accordingly, the hip defined by the gripping portion 4 may be perceived even if the material of the wrap 80 is opaque.

For each bottle 1 of the pack 40, the shoulder 5 here defines an outer diameter substantially equal to the greater outer diameter D, possibly equal to the diameter D1 defined at the lower portion 3 of the side wall 8. Such feature is of interest for grouping the bottles 1 in a wrapped pack 40 without significant gaps at the upper end 8*a* of the side wall 8 (thus preventing risk of tilting, irregular locations or alterations in the pack 40 due to shocks). Such risk occurs when the lower portion 3 does not provide sufficient contact areas between adjacent bottles 1.

Figure 11:
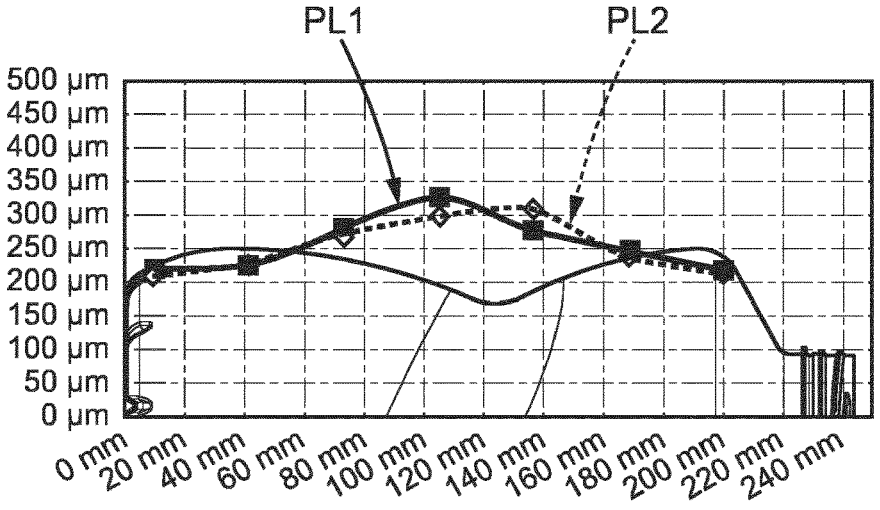
FIG. 11 is a diagram showing respective thickness profiles at opposite sides of a bottle in accordance to the invention.
Figure 12:
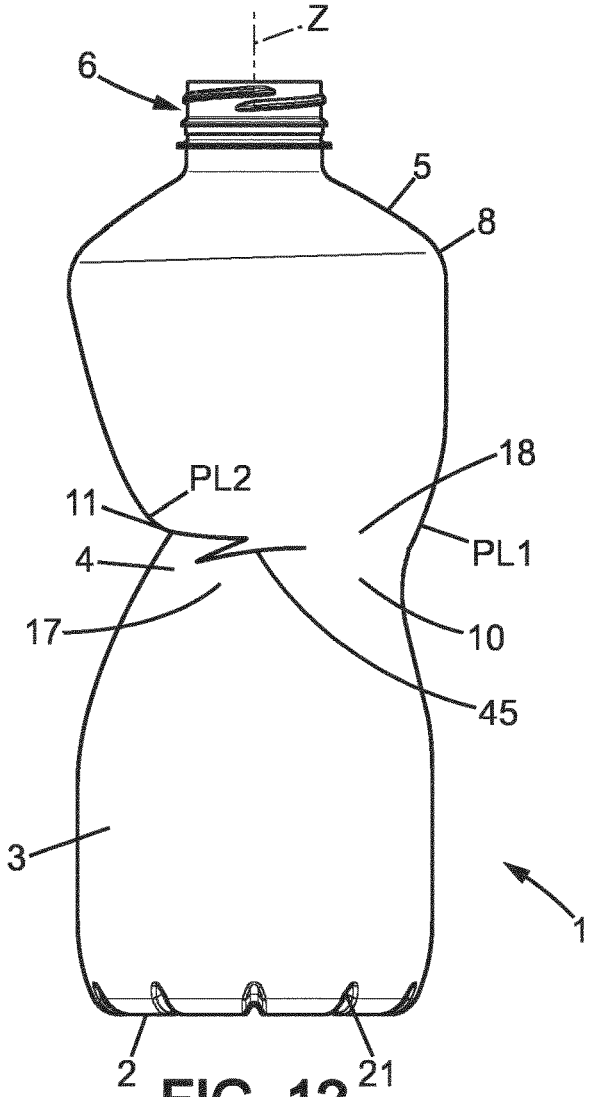
FIG. 12 shows a bottle having sensitive areas at the maximally recessed area of the gripping portion.

Now referring to FIGS. 4-8 and 11-12, it can be seen that the hip like arrangement defined at the gripping portion 4 raises issues in relation with the top load resistance. FIG. 12 exemplary illustrates some undesirable effects due to the fact that ds2<ds1, when there is no thick portion. The rupture area 45, which can be seen by the consumer (and which can cause leakage through the side wall 8), is typically caused by weight of the other bottles of the same stack.

To prevent such alteration in the gripping portion 4, increasing the average thickness of the gripping portion 4 cannot be seen as an economically relevant solution, especially in view of the significant height H1 of the gripping portion 4. Advantageously, the gripping portion 4 illustrated in FIGS. 4-6 and 10 is provided with respective thickness profiles at the opposite parting lines PL1 and PL2. The first thickness profile at the first parting line PL1 (see curve with small rectangles in the same diagram) and the second thickness profile at the second parting line PL2 (see curve with diamonds in the diagram of FIG. 11) can be seen as different in view of FIG. 11 and allow for a decrease of thickness in regions close to the annular line 15.

Referring to FIGS. 11 and 13, the second point 11*a* and the first point 19*a* are each provided with a thickness superior to 222 μm, preferably superior to 250 μm. The second point 11*a* and the first point 19*a* are defined in a same annular recess 10 for gripping that is tilted with respect to the support plane SP. Such annular recess 10 for gripping is part of the gripping portion 4 and the term "annular" has to be understood as entirely and continuously annular, so that a whole circumference for gripping is defined by the annular recess 10.

The following table 1 shows thickness profiles at the parting lines PL1 and PL2 in the side wall 8, for respective bottles 1 according to the invention. The height H here varies between 120 and 240 mm and the measured thickness, expressed in micrometers, is less than 500 μm at least for the PET stretched blow molded bottles 1.

TABLE 1

| height | Example 1 PET bottle; H = 240 | | Example 2 PET bottle; H = 225 | | Example 3 PE bottle; H = 120 | |
|---|---|---|---|---|---|---|
| (mm) | PL2 | PL1 | PL2 | PL1 | PL2 | PL1 |
| 40 | 225 | 225 | 202 | 202 | 500 | 580 |
| 50 | 240 | 240 | 245 | 250 | 505 | 668 |
| 60 | 255 | 255 | 300 | 340 | 552 | 552 |
| 70 | 268 | 275 | 350 | 396 | 448 | 582 |
| 80 | 275 | 295 | 350 | 425 | 459 | 540 |
| 90 | 285 | 317 | 330 | 440 | 498 | 488 |
| 100 | 292 | 323 | 324 | 445 | | |
| 110 | 300 | 325 | 348 | 400 | | |
| 120 | 305 | 305 | 378 | 325 | | |
| 130 | 310 | 280 | 359 | 284 | | |
| 140 | 302 | 270 | 310 | 266 | | |
| 150 | 278 | 259 | 262 | 260 | | |
| 160 | 254 | 251 | 233 | 252 | | |
| 170 | 242 | 248 | 224 | 250 | | |
| 200 | 215 | 218 | | | | |

The following table 2 shows average thickness in the gripping portion 4 for the respective examples of table 1. Maximum of thickness, which is typically measured at or 5 mm above the uppermost segment 15*a*, is also indicated. Preferably, at least twenty measures (here twenty-six measures) are used for obtaining the average thickness of the gripping portion 4 in the PET bottles. For the smaller PE bottle of example 3, ten or twelve measures in the gripping portion 4 are considered as sufficient to obtain a precise average thickness.

TABLE 2

| Gripping portion | Example 1 PET bottle; H = 240 | Example 2 PET bottle; H = 225 | Example 3 PE bottle; H = 120 |
|---|---|---|---|
| Average thickness | 279 μm | 321 μm | 530 μm |
| Max. of Thickness in PL1 | 310 μm | 378 μm | 552 μm |

In view of table 1, it can be seen that the first C-shaped portion 17 and the second C-shaped portion 18 are not profiled in a comparable manner. The maximum of thickness in the second parting line PL2 may be more or less similar but the respective profiles of thickness are optimally adjusted. The gripping portion 4 has a thickness profile such that an average thickness of this gripping portion 4 is less than the thickness measured in a specific region of the second annular part 14 at the maximally recessed area 11 (at the opposite from the lowermost segment 15*b*). Here, such thickness corresponds to the maximum value measured for the second parting line PL2. The thickness ratio of this maximum thickness measured in the specific region to the average thickness in the gripping portion 4 may be 1.05:1 to 1.3:1. Indeed having a thickness ratio between the thickness at second point 11*a* and the thickness at first point 19*a* of higher than 1, preferably of 1.05 to 1.30, preferably 1.10 to 1.25, has been surprisingly found to prevent collapse of the bottle 1 under top-load, particularly at second point 11*a*.

The region of locally increased thickness is preferably intersected by the symmetry plane P1. Thus, above the height level of the second point 11*a*, the second annular part 14 may be advantageously reinforced only along the second parting line PL2. FIG. 10 shows that such reinforcement may be localized at least at the intersection between the symmetry plane P1 and annular part 14, at and at or above the second point 11*a*.

In variants, thickness is increased adjacent the second parting line PL2 in two regions each adjacent to the uppermost segment 15*a* and extending along the parting line in the second annular part 14. More generally, it is understood that thickness is locally increased at or above the second point 11*a*, typically in at least one region where a thumb or another finger may exert a pressure when grasping the bottle 1 (this region may be higher than wide and/or only extend along the second parting line PL2 in an angular sector of less than 100° or 120°, using the first (central) axis Z as a reference). Such region may greater than 1 or 2 $cm^2$ and any thickness measured in this region may be at least 5 to 30%, preferably 10 to 25%, for example 15 or 20%, greater than the minimum thickness measured at the second parting line PL2 in the gripping portion 4.

The thick portion 23 of the second annular part 14 is provided along the second parting line PL2 (the thick portion 23 being intersected by the symmetry plane P1), and may extend from the second point 11*a* toward the upper annular end 13. Referring to FIG. 10, the at least one region of locally increased thickness, here defined by the thick portion 23, may be longitudinally distant from the upper annular end 13 of the second annular part 14. Indeed, the thickness is preferably reduced near the shoulder 5 or any other similar part not tapering downwardly and connected to the upper annular end 13. At the opposite from the thick portion 23, an opposite portion 24 extends from a determined lower end 24*a* (having same height level as the second point 11*a*) as far as the upper annular end 13. This opposite portion 24 is also intersected by the symmetry plane P1. It can be seen on FIG. 10 that such opposite portion 24 has a thickness lower than in the thick portion 23. It is understood that the opposite portion 24 is defined at same height level as the thick portion 23 (the portions 23 and 24 extend in a same longitudinal portion). Here, the thick portion 23 and the opposite portion 24 have a same longitudinal extension H3 (measured in the symmetry plane P1). The extension H3 may be superior or equal to 15 mm, and preferably inferior to 55 mm to allow the thickness to be significantly reduced near the annular upper end 13. The ratio H3/H12 may be comprised between 1:5 and 2:3, preferably between 1:4 and 1:2.

In the opposite portion 24, the thickness may progressively decrease with increasing space/longitudinal distance from the determined lower end 24*a*. In contrast in the thick portion 23 (as shown in FIG. 10), the thickness may be substantially constant or may locally increase with increasing space/longitudinal distance from the second point 11*a*. It is understood that thickness in the thick portion 23 is higher than any thickness measured in the opposite portion 24. Accordingly, plastic material can be saved in the second annular part 14 (especially above the determined lower end 24*a*), while the combination of the first and second annular parts 12, 14 provides a convenient, ergonomic and robust gripping area.

Referring to FIG. 13, a given point 25 of the first line PL1 is defined at same height as the height hs2 of the second point 11*a*. Such given point 25 (located in the determined lower end 24*a*) has a thickness that is typically at least 10 μm for example 20 or 25 μm lower than the thickness in the second point 11*a*. More generally, referring to FIGS. 10 and 11, it is understood that the ratio between the greater thickness (in the first point 11*a*) and the lower thickness (in the given point 25), in the symmetry plane P1 at height hs2, is preferably such that the following relation is satisfied:

$$3/5 \leq E2/E1 \leq 10/11$$

where E1 is the thickness in the second point 11*a*, and where E2 is the thickness in the opposite 25.

In one embodiment, the gripping portion 4 has a central region CR (see FIG. 10) defined between:

an annular lower limit having a constant height identical to the height hs1 of the first point 19*a;* and an annular upper limit having a constant height identical to the height hs2 of the second point 11*a*.

Typically, any thickness in the central region CR may be superior or equal to 220 μm, preferably 250 μm, which is of interest to provide an annular recess 10 that is more pronounced (i.e. with more restriction of the radial size as compared to the greater outer diameter D1), while offering sufficient strength for gripping operations.

Besides, a maximum difference in the central annular region CR may be superior or equal to 40 μm and inferior or equal to 400 μm.

Referring to FIGS. 2 and 4-6, it can be seen that the upper annular end 13 is typically perpendicular to the first (central) axis Z. At such upper annular end 13, the circumference may be substantially circular and the following relation may thus be satisfied:

$$ds2+EXT=ds1+x=D5/2$$

where D5 is the diameter defined by the upper annular end 13, as illustrated in FIG. 5.

While the thermoplastic bottle of example 1 may have a weight of about 33 g for a capacity of more than 1 litre (for instance about 1300 mL) with a diameter D1 of about 100 mm, the thermoplastic bottle of example 2 may have a weight of about 28 g for a capacity of less than 1 litre, for instance about 900 mL, with a diameter D1 of about 85 mm. The smaller bottle of example 3 has a greater thickness and may be suitable for containing dairy beverages or other similar drinks. Only thicknesses measured in the gripping portion 4 are reported for the bottle 1 of example 3. Of course, the examples shown in the table 1 are simply illustrative and reflect non-limiting embodiments.

It is understood that FIG. 11 illustrates a kind of bottle 1 as in example 1 of table 1. Such bottle 1 has a shape with minimized ratio EXT/D1, preferably EXT/D. In view of table 1, having such ratio (for example between 0.125 and 0.18) is of interest for minimizing the maximal thickness in the gripping portion 4. But a ratio EXT/D1, preferably EXT/D, comprised between 0.18 and 0.25 may be preferred because it provides higher visual impact (this is actually the case for the bottle of example 2), being understood that height H1 of the gripping portion 4 may be the same as in the bottle of example 1 for defining a progressive rounding in the first C-shaped portion 17. For example 2, having the specific thickness profiles in the gripping portion 4 allows for high difference between the maximum of thickness (here 378 μm) measured in the second annular part 14 at the maximally recessed area 11 and the average thickness of the gripping portion 4 (here 321 μm only)

More generally, the thickness ratio of this thickness measured in the specific region (maximum thickness in the parting line PL2 at the gripping portion 4) to a minimum thickness in the gripping portion 4 may be typically comprised in the range 1.1:1 to 1.9:1.

The second thickness profile defined at the parting line PL2 and the first thickness profile defined at the parting line PL1 each have locally a maximum in the gripping portion 4, respectively corresponding to the maximally recessed area 11 and a less recessed area (defined around the lowermost segment 15*b* and which may correspond to the minimally recessed area 19 in the annular recess 10). Because of such thickness profiles, the average thickness of the gripping portion 4 is significantly lowered. Maximum difference in thickness in the gripping portion 4 may be for example greater than 40 or 50 μm and inferior or equal to 400 μm.

Referring to FIGS. 8 and 11, it can be seen that the first C-shaped portion 17 has a profile of thickness with a first progressive reduction of thickness in a first sloped section 51 between the uppermost segment 15*a* and a first area 55 located at a longitudinal distance of 30 mm below the uppermost segment 15*a*. Besides, the second C-shaped portion 18 has a profile of thickness with a second progressive reduction of thickness in a second sloped section 52 between the lowermost segment 15*b* and a second area 56 located at a longitudinal distance of 30 mm above the lowermost segment 15*b*. The thickness in the second area 56 is preferably less than thickness in the first area 55, due to a greater decrease in thickness at the second sloped section 52. Accordingly, significantly less plastic material may be used in the second C-shaped portion 18 in the region between the shoulder 5 and the determined annular line 15. This is due to the minimally recessed area 19, located at the parting line PL1 between the two symmetrical halves 41, 42, and which is structurally more resistant to top load constraints.

Due to the specific increases in thickness in the respective parting lines PL1 and PL2, a better resistance is obtained for the gripping portion 4, so as to reduce impact in the most sensitive areas of such gripping portion 4. Concretely, as compared to a bottle having low variations around the average thickness, the bottle 1 may withstand an additional top load of about 20 daN due to such controlled thickness profiles in the respective C-shaped portions 17, 18.

The present invention has been described in connection with the preferred embodiments. These embodiments, however, are merely for example and the invention is not restricted thereto. For instance, the top and the bottom of the bottles 1 may have a variety of shape, with the provision that the first (central) axis Z defines a common central axis for the base B and the part above the gripping portion 4. While the bottom wall 2 has been illustrated with spaced feet and grooves, the bottom wall 2 may also define a continuously circular bearing area.

Besides, in some variants, the diameter D1 in the lower portion 3 is not necessarily the greater diameter of the bottle 1. The shoulder 5 may be optionally provided with a greater diameter.

The side wall 8 may be provided with strengthening ribs (not shown), for example in the lower portion 3, in the shoulder 5, and optionally in regions of the respective annular parts 12 14 (regions where thickness is decreased by the thickness profiles) proximal to the lower portion 3 and the shoulder 5, respectively. Such ribs extend each between two narrow annular grooves of low depth (inferior to 2 mm for instance), so as to prevent formation of local protrusions protruding radially outwards. The width of such grooves is typically inferior to 4 mm, while minimal distance between two grooves (delimiting a single rib in between) may be superior to 10 mm, preferably at least 12 mm.

Any reference sign in the following claims should not be construed as limiting the claim. It will be obvious that the use of the verb "to comprise" and its conjugations does not exclude the presence of any other elements besides those defined in any claim. The word "a" or "an" preceding an element does not exclude the presence of a plurality of such elements.

The invention claimed is:

1. A thermoplastic bottle comprising:

a bottom wall defining a support plane;

a neck provided with an opening of the bottle;

a shoulder connected to the neck; and a side wall extending longitudinally around a central axis of the bottle between the bottom wall and the shoulder, the side wall having a symmetry plane including the central axis, the side wall having a first line and a second line where the side wall intersects with the symmetry plane, wherein the first line is provided with a first point at a radial distance dsl from the central axis which is a minimal distance between the first line and the central axis, wherein the second line is provided with a second point at a radial distance ds2 from the central axis, which is a minimal distance between the second line and the central axis and a minimal distance between the side wall and the central axis, wherein the following relations are satisfied:

$$ds2<ds1$$

$$hs1<hs2,$$

where hs1 is a height of the first point and hs2 is a height of the second point, each of the height hs1 of the first point and the height hs2 of the second point being measured parallel to the central axis from the support plane, and wherein the side wall comprises at the second line at least one thick portion that extends at and above the second point, said thick portion having a thickness that is greater than a thickness provided in the first line at a same height as the height hs2 of the second point.

2. The thermoplastic bottle according to claim 1, wherein said thick portion has a minimum thickness, which is at least 20 μm greater than the thickness provided at the first line at the same height as the height hs2 of the second point.

3. The thermoplastic bottle according to claim 1, wherein the second point and the first point are parts of a gripping portion having an annular recess maximally recessed at the second point, the gripping portion comprising:

the thick portion, and a central region defined between an annular lower limit extending at a constant height identical to the height of the first point and an annular upper limit extending at a constant height identical to the height of the second point, wherein a wall thickness in the central region, at any point along the first line and the second line, is superior or equal to 250 μm.

4. The thermoplastic bottle according to claim 1, wherein the side wall comprises:

a lower portion adjacent to the bottom wall and extending symmetrically around the central axis, a first annular part connected to the lower portion, the first annular part and the lower portion intersecting and interconnecting at a circular peripheral intersection line that is perpendicular to the central axis, and a second annular part having an upper annular end perpendicular to the central axis, wherein the second point and the first point are located in a determined annular line tilted with respect to the support plane, the determined annular line defining a peripheral intersection between the first annular part and the second annular part, at a distance from the upper annular end of the second annular part, the first annular part and the second annular part longitudinally tapering in opposite directions and defining a gripping portion of the bottle.

5. The thermoplastic bottle according to claim 4, wherein the determined annular line is a continuously rounded annular line, and wherein the following relation is verified:

$$ds1-ds2 \geq 4 \text{ mm}.$$

6. The thermoplastic bottle according to claim 4, wherein the determined annular line is comprised in a single virtual plane.

7. The thermoplastic bottle according to claim 1, wherein the second line has an upper point above the second point, the second line having, above the second point, a longitudinal profile provided with a maximal radial extension measured perpendicularly to the central axis at the upper point, wherein the thermoplastic bottle has a height extension measured parallel to the central axis between the second point and said upper point of the second line, and wherein a ratio between the maximal radial extension and said height extension is comprised between 1:8 and 2:5.

8. The thermoplastic bottle according to claim 1, wherein the side wall is provided with a gripping portion connected to the shoulder at a circular junction, the shoulder extending symmetrically around the central axis.

9. The thermoplastic bottle according to claim 1, wherein the second point and the first point are defined in a same annular recess for gripping that is tilted with respect to the support plane.

10. The thermoplastic bottle according to claim 1, further comprising a decorative label extending below the neck in an upstanding position of the bottle, in order to cover the side wall, the side wall having a peripheral outer face in direct contact with the decorative label, wherein the side wall is deprived from any projection protruding from the peripheral outer face.

11. The thermoplastic bottle according to claim 10, wherein the decorative label is a one piece plastic sleeve that includes a shrink film being in contact with the first line and the second line.

12. The thermoplastic bottle according to claim 4, wherein the second point and the first point are defined in a same annular recess for gripping that is tilted with respect to the support plane.

13. The thermoplastic bottle according to claim 4, further comprising a one piece plastic sleeve that includes a shrink film being in contact with the first line and the second line, in order to form a decorative label that surrounds and covers the side wall.

14. The thermoplastic bottle according to claim 1, wherein the following relationships is satisfied:

$$0.02 \leq (ds1-ds2)/D \leq 0.10,$$

where D is a greatest outer diameter of the thermoplastic bottle.

15. The thermoplastic bottle according to claim 4, wherein the following relationships is satisfied:

$$0.02 \leq (ds1-ds2)/D \leq 0.10,$$

where D is a greatest outer diameter of the thermoplastic bottle.

16. The thermoplastic bottle according to claim 4, wherein the determined annular line is tilted with respect to the support plane with an angle value that is in range 10-30°.

* * * * *